United States Patent [19]

Gabryszewski

[11] Patent Number: 4,957,783

[45] Date of Patent: Sep. 18, 1990

[54] METHOD AND APPARATUS FOR DISPENSING DROPLETS OF MOLTEN THERMOPLASTIC ADHESIVE

[75] Inventor: Gregory J. Gabryszewski, Lithonia, Ga.

[73] Assignee: Nordson Corporation, Westlake, Ohio

[21] Appl. No.: 411,181

[22] Filed: Sep. 27, 1989

Related U.S. Application Data

[63] Continuation-in-part of Ser. No. 254,264, Oct. 5, 1988, Pat. No. 4,911,956.

[51] Int. Cl.[5] ..... B05D 1/02; B05B 1/08

[52] U.S. Cl. ..... 427/424; 118/300; 427/207.1; 239/99; 239/101; 239/296; 239/413

[58] Field of Search ..... 118/300; 427/207.1, 427/424; 239/99, 101, 296, 425.5, 413

[56] References Cited

U.S. PATENT DOCUMENTS

| | | | |
|---|---|---|---|
| 2,638,381 | 5/1953 | Paxton | 299/25 |
| 3,348,520 | 10/1967 | Lockwood | 118/2 |
| 3,434,865 | 3/1969 | Doquire et al. | 117/37 |
| 4,241,880 | 12/1980 | Hastings | 239/691 |
| 4,273,293 | 6/1981 | Hastings | 239/705 |
| 4,294,411 | 10/1981 | Hastings | 239/707 |
| 4,478,370 | 10/1984 | Hastings | 239/707 |
| 4,502,629 | 3/1985 | McGhee et al. | 239/3 |
| 4,576,827 | 3/1986 | Hastings | 427/27 |
| 4,630,774 | 12/1986 | Rehman | 239/8 |
| 4,711,683 | 12/1987 | Merkatoris | 156/164 |
| 4,721,252 | 1/1988 | Colton | 239/424.5 |

*Primary Examiner*—Shrive Beck

*Attorney, Agent, or Firm*—Wood, Herron & Evans

[57] ABSTRACT

A method and apparatus for dispensing droplets of molten thermoplastic adhesive onto a moving substrate comprises a spray device having a nozzle formed with a discharge outlet which ejects a continuous stream of molten thermoplastic adhesive. A stitcher device connected to a source of pressurized air is operative to supply intermittent, pulsed jets of atomizing air to air jet bores associated with the nozzle which discharge the pulsed air jets into contact with the exterior of the continuous stream of molten thermoplastic material with sufficient energy to shear well defined globules or droplets from the continuous stream and either allow such droplets to fall onto the substrate under the influence of gravity and due to the momentum of the stream in an essentially straight-line pattern, or to project such droplets onto the substrate to form an essentially random pattern of droplets.

14 Claims, 3 Drawing Sheets

METHOD AND APPARATUS FOR DISPENSING DROPLETS OF MOLTEN THERMOPLASTIC ADHESIVE

This is a continuation-in-part application of U.S. Pat. Application Ser. No. 07/254,264 to Gabryszewski et al, filed Oct. 5, 1988 and entitled "Apparatus For Spraying Droplets of Hot Melt Adhesive", which is owned by the assignee of this invention and now U.S. Pat. No. 4,911,956.

FIELD OF THE INVENTION

This invention relates to a method and apparatus for dispensing molten thermoplastic adhesive, and, more particularly, to a method and apparatus for dispensing well defined droplets of molten thermoplastic adhesive onto a moving substrate for subsequent bonding with another substrate.

BACKGROUND OF THE INVENTION

Hot melt thermoplastic adhesives have been widely used in industry for adhering many types of products, and are particularly useful in applications where quick setting time is advantageous. One application for hot melt adhesive which has met with considerable commercial success is the fabrication of cartons wherein the quick setting time of hot melt adhesive is useful in assembling the flaps of a carton in high speed cartoning lines.

A number of dispensers have been employed to deposit hot melt adhesive onto the flaps of cartons, or on other substrates where quick setting time is required. For example, one type of adhesive dispenser is a gun formed with an adhesive passageway connected to a nozzle having a discharge orifice. The adhesive is pumped through the gun and ejected from the discharge orifice of the nozzle in the form of a relatively thick bead of molten thermoplastic adhesive which is applied to the substrate. Another substrate is then placed into contact with the first substrate to "flatten" or spread out the adhesive bead over a larger surface area so that an acceptable bond is produced between the substrates.

One disadvantage of adhesive dispensers which discharge an adhesive bead is that a relatively large quantity of adhesive is required to obtain the desired bond. Molten thermoplastic adhesive is highly viscous and does not readily spread over the surface of one substrate even when a second substrate to be bonded thereto is pressed against the adhesive bead. As a result, a relatively large quantity of adhesive is required in forming the bead to ensure the surface area of the bond between the substrates is sufficient to adhere the substrates together.

Several attempts have been made in the prior art to lessen the quantity of thermoplastic adhesive required to bond two substrates together while obtaining acceptable bond strength between the substrates. In one prior art apparatus, the hot melt adhesive is transmitted under pressure to the discharge orifice of a nozzle. When the hot melt adhesive is ejected into the ambient air, it atomizes and forms a spray or mist of tiny droplets which are deposited onto the substrate. These small droplets cover a larger surface area than a single adhesive bead, and since bond strength is dependent in part on the surface area covered by the adhesive, a lesser quantity of adhesive in droplet form can be employed than is required with an adhesive bead.

One problem with spraying molten thermoplastic material in tiny droplets onto a substrate is that in order for the adhesive to completely atomize before it reaches the substrate, the nozzle must be positioned a relatively large distance from the substrate. As a result, the small droplets are exposed to ambient temperatures and tend to cool before they reach the substrate. It has been found that with some types of hot melt adhesives the droplets either harden before they contact the substrate or fail to retain sufficient specific heat after they reach the substrate to permit bonding to another substrate. Additionally, nozzles of the type designed to spray thermoplastic adhesive in highly atomized form can produce elongated strings or fibers of adhesive instead of droplets when the nozzle is first turned on and/or when the nozzle is shut off. These strings of adhesive tend to clog the nozzle and/or are deposited in that form onto the substrate.

Another attempt to reduce the quantity of adhesive utilized for cartoning applications and the like is found in U.S. Pat. No. 3,348,520 to Lockwood. The apparatus disclosed in the Lockwood patent produces relatively large drops of molten thermoplastic adhesive which are deposited onto one substrate for bonding with another substrate. The individual drops of adhesive are obtained by alternately opening and closing valves located in the adhesive supply lines upstream from nozzles connected to the supply lines. One problem with apparatus of the type disclosed in the Lockwood patent is that the valves which form the adhesive drops must open and close at extremely high rates to keep up with the speeds of modern cartoning lines, and they tend to wear or fail after relatively short periods of use.

Another approach in the prior art for spraying hot melt adhesives is found in U.S. Pat. No. 4,721,252 to Colton. This patent discloses an apparatus in which molten thermoplastic adhesive is ejected through the discharge orifice of a nozzle and a tube carrying pressurized air is positioned in the center of the adhesive stream ejected from the nozzle. As the pressurized air emerges from the tube, it expands radially outwardly and breaks up the hot melt adhesive in the stream to form droplets or blobs of adhesive which are then deposited on the substrate. Multiple air delivery tubes can be employed to control the width of the spray pattern of droplets formed.

The apparatus disclosed in the Colton Pat. No. 4,721,252 produces a randomly distributed pattern of thin, disk-shaped droplets and a relatively large amount of strings or strand-like fibers of adhesive between the droplets. The problem with thin, diskshaped droplets is that they have a relatively short "open time", i.e., lower mass, thin droplets tend to cool and lose their ability to bond to another substrate in a relatively short period of time. Moreover, the strings or strand-like fibers formed in between the flat droplets cool so rapidly that they contribute little or nothing to the bond created between two substrates and constitute a waste of adhesive. Additionally, a randomly dispersed or distributed pattern of droplets and strand-like fibers of adhesive is unacceptable in certain applications wherein the location and size of the adhesive pattern must be confined to a limited area.

SUMMARY OF THE INVENTION

It is therefore among the objectives of this invention to provide an apparatus for dispensing droplets or blobs of molten thermoplastic adhesive which optimizes the shape of the adhesive droplets, which reduces the formation of strings or strand-like fibers therebetween, which increases the open time of the droplets, which reduces cut-off drool of adhesive at the spray nozzle, which controls the size, spacing and pattern of the droplets, and which permits adjustment of the density of adhesive sprayed onto a moving substrate to correspond with the speed of the substrate.

These objectives are accomplished in an apparatus for spraying molten, thermoplastic adhesive in droplet form which comprises a gun body having a nozzle formed with a tapered, conical or bell-shaped discharge outlet for ejecting a continuous stream of thermoplastic adhesive. The nozzle is also formed with air jet bores for directing bursts or jets of atomizing air at the exterior of the continuous stream of thermoplastic adhesive. A stitching device connected to a source of pressurized air is operative to supply atomizing air to the nozzle of the gun body in intermittent or pulsed, high velocity jets. These pulsed or intermittent jets of atomizing air initially impact the outside or exterior surface of the continuous stream of thermoplastic adhesive ejected from the nozzle and shear or break up such stream into droplets which are deposited onto a substrate.

It has been found that the impact of rapidly pulsed, intermittent air jets with a continuous stream of molten thermoplastic adhesive ejected from a tapered discharge outlet, results in the formation of adhesive droplets which have a well defined, more nearly optimum shape than has been obtained with prior art systems. The atomized adhesive droplets formed by this invention have a partially spherical shape when deposited onto a substrate with a minimal amount of "angel hair" formed therebetween, i.e., stringy or strand-like fibers of adhesive. These partially spherical-shaped droplets have a relatively high mass for the area they occupy, compared to prior art, mist-like droplets or thin, disk-shaped droplets, and therefore retain their specific heat for a relatively long period of time. This increases the "open time" of the droplets, i.e., the time period in which such droplets remain sufficiently molten to form a good bond with another substrate brought into contact therewith.

In the presently preferred embodiment, a commercially available "stitcher" device, such as those available from Numatics, Inc., is employed to supply pulsed or intermittent jets of atomizing air to the spray nozzle. Stitcher devices of this type are adjustable to vary the frequency of the pulsed air jets which impact the continuous stream of adhesive ejected from the nozzle. Pressurized air is supplied to the stitcher device from a source connected to a regulator which is operative to control the pressure of the atomizing air supply of the stitcher device.

An important aspect of this invention is the control of the droplet pattern deposited onto a substrate which is obtained by the apparatus and method of this invention. As mentioned above, the intermittent pulses or bursts of atomizing air are effective to shear successive blobs or droplets from the continuous stream of adhesive ejected from the discharge outlet of the dispensing device. Depending upon the total "energy" of the atomizing air stream, i.e., its pressure, flow rate and the frequency of the intermittent bursts of atomizing air, a different pattern of adhesive droplets is obtained on a substrate. The energy input of the atomizing air stream is controlled by operation of a pressure regulator, the stitcher device and a flow control valve located downstream from the stitcher device.

It has been found that a certain amount of energy of the atomizing air stream is required to shear the continuous stream of adhesive into individual droplets. If the atomizing air stream is provided with a greater amount of energy than that required to shear the adhesive stream, the adhesive blobs or droplets are projected onto the substrate by the atomizing air. This produces a "stipple" pattern in which the adhesive droplets are essentially randomly deposited on the substrate and at least some thin or strand-like fibers of adhesive are formed between the droplets. On the other hand, if the energy of the atomizing air stream is reduced to a level wherein it is only sufficient to shear the continuous adhesive stream into droplets, the adhesive droplets are permitted to fall onto the substrate under the influence of gravity and due to the momentum of the adhesive stream. This produces a pattern of substantially uniformly sized droplets which are regularly spaced along a substantially straight line onto the moving substrate. Minimal fiber-like strands of adhesive are produced between the droplets.

It is contemplated that in practicing the method of this invention, some adjustment of the pressure, flow rate and frequency of intermittent bursts of atomizing air will be required depending upon other operating parameters. It is contemplated that in most applications, a particular type of hot melt thermoplastic adhesive would be chosen having a known viscosity and melt temperature. The hydraulic pressure at which the adhesive is transmitted through the dispensing device would be determined by the quantity of adhesive needed to obtain the required bond strength. Given these parameters, the pressure, flow rate and frequency of the intermittent bursts of atomizing air are adjusted by the operator so that the appropriate amount of energy of the atomizing air stream is provided to obtain the desired pattern of adhesive droplets on the substrate. As discussed above, higher energy levels of the atomizing air stream not only shears the adhesive stream into droplets, but also projects such droplets onto the substrate to produce a stipple pattern in which the droplets are randomly distributed and have at least some thin or fiber-like streams of adhesive therebetween. If the atomizing air stream is discharged with a lower energy level, i.e., sufficient to only shear the adhesive stream into droplets, then such droplets fall under the influence of gravity and due to the momentum of the adhesive stream onto the substrate to produce a longitudinally extending, straight-line pattern of adhesive droplets having a uniform size which are regularly spaced from one another.

In another aspect of this invention, the size of the adhesive droplets produced by the method and apparatus of this invention can be varied as desired. One way of varying the droplet size is to provide a higher or lower mass flow rate of adhesive through the discharge outlet of the dispenser device. The greater the mass flow rate of adhesive through the discharge outlet of the dispenser, the larger the size of the droplets produced.

The mass flow rate can be varied by either increasing or decreasing the temperature of the adhesive to alter its viscosity. An increase in temperature of the adhesive lowers its viscosity and thus permits more mass flow of adhesive through the discharge outlet of the dispenser at constant hydraulic pressure. Conversely, lowering the adhesive temperature increases its viscosity and thus a lower mass flow rate of the adhesive is obtained through the discharge outlet of the dispenser. Mass flow rate can also be varied by increasing or decreasing the hydraulic pressure applied to the adhesive stream within the dispenser device.

A still further parameter which can be adjusted to vary droplet size is the frequency of intermittent pulses or bursts of atomizing air jets from the stitcher device which shear droplets from the adhesive stream. Generally, as the frequency of the pulses or bursts of atomizing air increases, the droplet size decreases because the adhesive stream is sheared more frequently as it is ejected from the discharge outlet of the dispenser. On the other hand, as the frequency of the intermittent bursts or pulses of atomizing air decreases, the droplet size of the adhesive increases.

In another aspect of this invention, the adjustment capability of the stitcher device enables the apparatus of this invention to be employed in applications wherein a moving substrate is to be sprayed with adhesive material and the speed of the moving substrate is variable. For example, assume a substrate to be sprayed is moving at a first speed past the apparatus of this invention, and it is desired to spray a predetermined density of adhesive onto a unit length of the substrate. In this instance, the stitcher device is adjusted so that the frequency of the air jets ejected from the nozzle shear an appropriate quantity of adhesive droplets for deposition onto the substrate. In the event the substrate is moved at a higher or lower velocity past the apparatus herein, the stitcher device can be adjusted to vary the frequency of the pulsed jets of air supplied to the nozzle so that the same density of adhesive is deposited onto a unit length of the substrate at such different velocities.

In another aspect of this invention, a clean-out capability is provided for the removal of residual hot melt adhesive from the discharge outlet of the nozzle of the spray gun after operation of the spray gun is terminated. In the presently preferred embodiment, a solenoid valve connected to a source of pressurized air controls the flow of atomizing air to the stitcher device. Normally, when operation of the spray gun is terminated, the air remaining in the stitcher device and air lines leading thereto is bled out of the system in the opposite direction through the solenoid valve to atmosphere. In this invention, the solenoid valve is modified to block the flow of bleed-back air therethrough. Instead, air remaining in the lines leading to the stitcher device, and in the stitcher device itself, is forced in the opposite direction through the air jet bores in the nozzle so that any residual adhesive at the discharge outlet of the nozzle is removed by such reverse air flow. This effectively cleans the spray nozzle and prevents "drool" of adhesive after the spray gun operation is terminated.

The apparatus of this invention has several advantages over the prior art. The intermittent, pulsed bursts of atomizing air directed at the exterior of the continuous stream of hot melt adhesive are effective to shear the adhesive material and form well defined, partially spherical-shaped droplets of adhesive on a substrate. The bell-shaped mouth of the discharge outlet in the nozzle also aids in obtaining clean, sharply defined droplets with minimal formation of angel hair. Prior art apparatus, on the other hand, tend to form very fine droplets which quickly cool, or relatively flat, thin disk-shaped droplets which have much less open time, i.e., retain their specific heat for relatively short periods of time on a substrate.

Additionally, prior art apparatus for spraying highly viscous, molten thermoplastic adhesive tend to form an adhesive pattern consisting of randomly dispersed adhesive droplets and a relatively large quantity of angel hair. The randomly dispersed droplets are unacceptable in some applications wherein the position and size of the adhesive pattern must be controlled. In addition, the angel hair formed by prior art apparatus rapidly cools on the substrate and is ineffective in forming a bond with another substrate which wastes adhesive.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
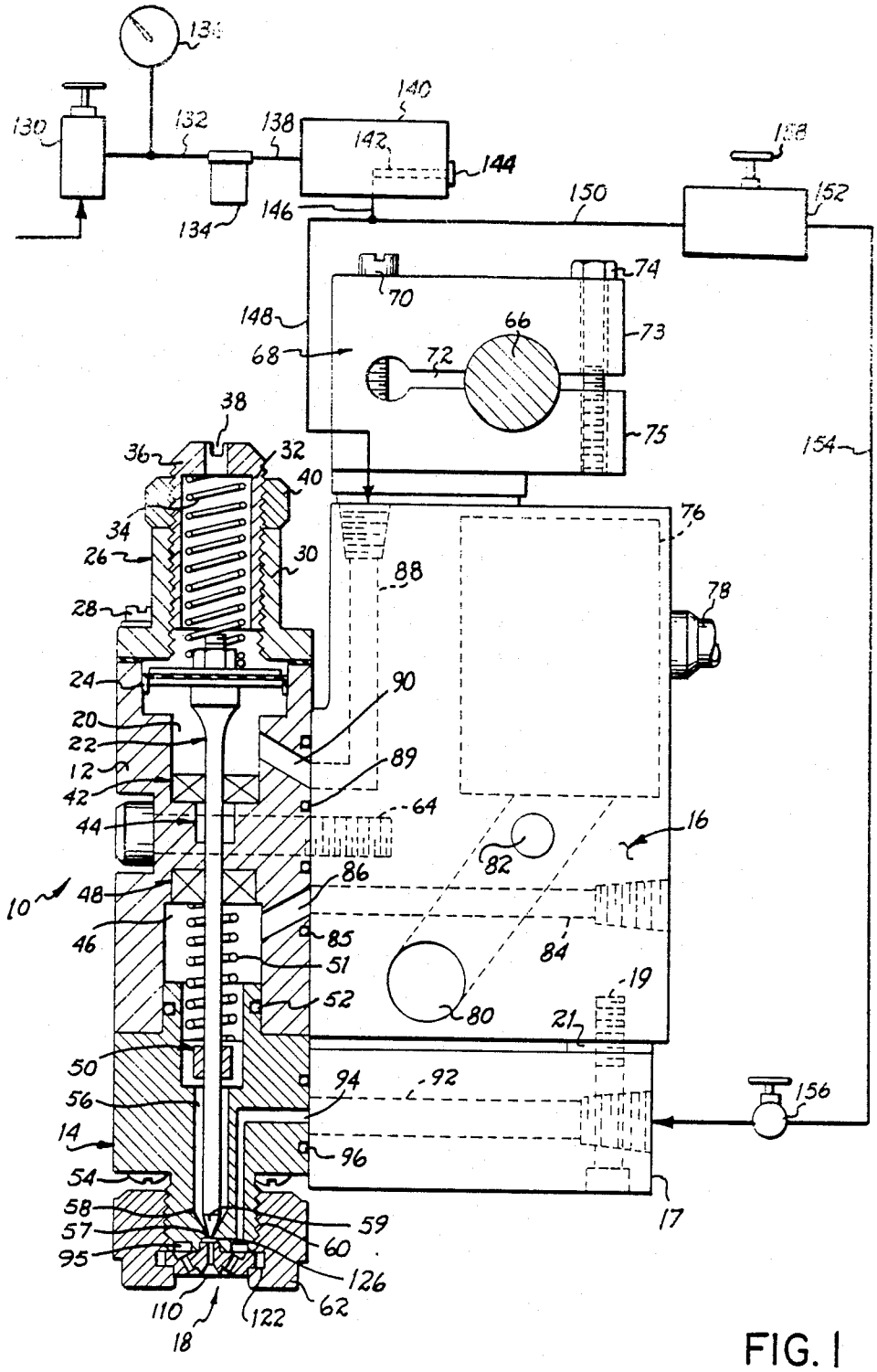
FIG. 1 is a cross sectional view of a spray gun and a schematic view of a system for supplying pulsed jets of atomizing air to the spray gun.

Referring now to FIG. 1, an adhesive spray device 10 is illustrated comprising a gun body 12 having a nozzle 14 connected at one end, and an adhesive manifold 16 and air manifold 17 mounted to the gun body 12. The air manifold 17 is mounted to the adhesive manifold 16 by two or more screws 19, each of which extend through a spacer 21 extending between the manifolds 16, 17. The nozzle 14 supports a nozzle attachment 18 from which a continuous bead of molten thermoplastic material, i.e., hot melt adhesive is discharged and impacted by intermittent, pulsed jets of atomizing air to form adhesive droplets, as discussed in detail below. The structure of the gun body 12 and manifolds 16, 17 are substantially identical to the Model H200 spray gun manufactured and sold by the assignee of this invention, Nordson Corporation of Westlake, Ohio. These elements form no part of the invention per se and are thus discussed only briefly herein.

As shown in FIG. 1, the upper portion of gun body 12 is formed with an air cavity 20 which receives the upper end of a plunger 22 having a head plate 24. The head plate 24 is slidable within the air cavity 20 and has a seal therein which seals against the cavity wall. A collar 26 is mounted to the upper end of gun body 12, such as by bolts 28, which is formed with a throughbore defining an inner, threaded wall 30. The collar 26 receives a plug 32 having external threads which mate with the threaded wall 30 of the collar 26. The plug 32 is hollow and a spring 34 is mounted in its interior which extends between the top end of the plunger 22 and the head 36 of plug 32 having a screw slot 38. A lock nut 40 is threaded onto the plug 32 into engagement with the top edge of the collar 26.

The plug 32 is rotatable with respect to the collar 26 to vary the force applied by the spring 34 against the top edge of plunger 22. In order to rotate the plug 32, the lock nut 40 is first rotated to disengage the collar 26 after which a screwdriver is inserted into the screw slot 38 in the head 36 of plug 32 and rotated to move the plug 32, and in turn increase or decrease the compression force of spring 34 within the collar 26.

The plunger 22 is sealed at the base of the air cavity 20 by a seal 42 which permits axial movement of the plunger 22 therealong. The plunger 22 extends downwardly through the gun body 12 from the air cavity 20 through a stepped bore 44 which leads into an adhesive cavity 46 having a seal 48 at its upper end and a plunger mount 50 at its lower end. A return spring 51 mounted to the plunger 22 is disposed within the adhesive cavity 46 and extends between the seal 48 and plunger mount 50. Both the narrow portion of the stepped bore 44 and the plunger mount 50 aid in guiding the axial movement of plunger 22 within the gun body 12.

The upper end of the nozzle 14 extends into the adhesive cavity 46 and is sealed thereto by an O-ring 52. The nozzle 14 is fixed to the gun body 12 by screws 54. The plunger 22 extends downwardly from the adhesive cavity 46 and plunger mount 50 into an adhesive passageway 56 formed in the nozzle 14 which terminates at an adhesive discharge opening 57. Immediately upstream from the adhesive discharge opening 57, the adhesive passageway 56 is formed with a conical-shaped seat 58 which mates with the terminal end 59 of the plunger 22. As discussed below, movement of the plunger 22 relative to the seat 58 controls the flow of heated hot melt adhesive ejected from adhesive passageway 56 through its adhesive discharge opening 57.

The nozzle 14 is also formed with a reduced diameter portion having external threads 60 which mate with internal threads formed in a cap 62. As described below, the cap 62 mounts the nozzle attachment 18 to the base of nozzle 14 in communication with the discharge opening 57 of adhesive passageway 56.

The gun body 12 is mounted to the adhesive manifold 16 by mounting bolts 64. In turn, the adhesive manifold 16 is supported on a bar 66 by a mounting block 68 connected to the adhesive manifold 16 with screws 70. As illustrated at the top of FIG. 1, the mounting block 68 is formed with a slot 72 forming two half sections 73, 75 which receive the bar 66 therebetween. A bolt 74 spans the half sections 73, 75 of the mounting block formed by the slot 72 and tightens them down against the bar 66 to secure the mounting block 68 thereto.

The adhesive manifold 16 is formed with a junction box 76 which receives an electric cable 78 to supply power to a heater 80 and an RTD 82. The heater 80 maintains the hot melt adhesive in a molten state when it is introduced into the adhesive manifold 16 through an adhesive inlet line 84 from a source of hot melt adhesive (not shown). The adhesive inlet line 84 communicates through a connector line 86 formed in the gun body 12 with the adhesive cavity 46. An O-ring 85 is provided between the gun body 12 and adhesive manifold 16 at the junction of the adhesive inlet line 84 and connector line 86 to form a seal therebetween. Operating air for the plunger 22 is supplied through an inlet line 88 formed in the adhesive manifold 16 which is joined by a connector line 90 to the air cavity 20. The gun body 12 and manifold are sealed thereat by an O-ring 89.

The air manifold 17 is formed with an air inlet line 92 connected to an air delivery passageway 94 formed in the nozzle 14 which terminates in an annular chamber 95 at the base of the nozzle 14. O-ring seal 96 forms a fluid-tight seal between the nozzle 14 and air manifold 17 at the intersection of air inlet line 92 and air delivery passageway 94.

Figure 2:
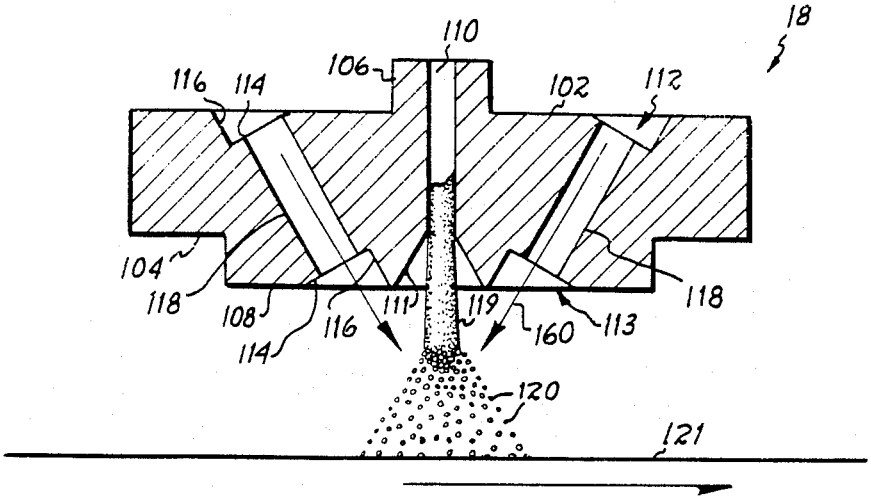
FIG. 2 is an enlarged cross sectional view of a nozzle attachment associated with the nozzle of the spray gun showing an adhesive bead impacted by air jet streams and a moving substrate beneath.

Referring now to the bottom of FIG. 1 and to FIG. 2, the nozzle attachment 18 is shown in detail. The nozzle attachment 18 is an annular plate having one side formed with a first or upper surface 102 and an opposite side formed with a second or lower surface 104 spaced from the upper surface 102. A boss 106 extends outwardly from the upper surface 102, and a nozzle tip 108 extends outwardly from the lower surface 104 concentric to boss 106. A throughbore 110 is formed in the nozzle attachment 18 between the boss 106 and nozzle tip 108 which has a discharge outlet 111. The diameter of the tapered discharge outlet 111 decreases from the second or lower surface 104 toward the first or upper surface 102 so that the discharge outlet 111 is formed with a radially inwardly tapering sidewall relative to the longitudinal axis of throughbore 110 and has a generally conical shape.

One annular, V-shaped groove 112 is formed in the nozzle attachment 18 which extends inwardly from its upper surface 102 toward the lower surface 104. A second annular, V-shaped groove 113 is formed in nozzle attachment 18 which extends inwardly from its lower surface 104 toward the upper surface 102. Each annular groove 112, 113 defines a pair of sidewalls 114, 116 which are substantially perpendicular to one another. In a presently preferred embodiment, the sidewall 116 is formed at approximately a 30° angle with respect to the planar upper and lower surfaces 102, 104 of the nozzle attachment 18. Four air jet bores 118 are formed in the nozzle attachment 18 between the annular grooves 112, 113, at 90° intervals therealong. See FIG. 3. Preferably, each air jet bore 118 is formed at an angle of approximately 30° with respect to the longitudinal axis of the throughbore 110.

The annular grooves 112, 113 facilitate accurate drilling of the air jet bores 118 so that they are disposed at the desired angle relative to throughbore 110. By forming the sidewall 116 at a 30° angle relative to the upper and lower surfaces 102, 104 of nozzle attachment 18, a drill bit (not shown) can enter the annular groove 112 or 113 in the nozzle attachment 118 at a 30° angle relative to its upper and lower surfaces 102, 104, but contact the sidewall 114 formed in the annular grooves 112, 113 at a 90° angle. As a result, the drilling operation is performed with minimal slippage between the drill bit and nozzle attachment 18 to ensure the formation of accurately positioned air jet bores 118.

Figure 3:
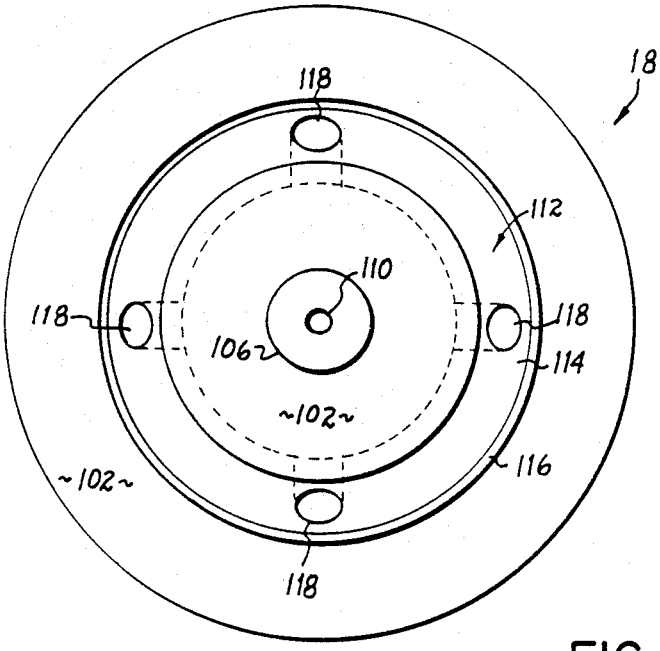
FIG. 3 is a plan view of the nozzle attachment shown in FIG. 2.

As shown in FIGS. 2 and 3, the longitudinal axis of each of the air jet bores 118 is angled to intersect the center of a continuous stream 119 of hot melt adhesive material ejected from the discharge outlet 111 of nozzle attachment 18. As discussed in detail below, atomizing air passes through each of the air jet bores 118 and impacts the outside of adhesive stream 119 to form droplets 120 for deposition onto a substrate 121.

Referring now to FIG. 1, the cap 62 is formed with an annular seat 122 which receives the nozzle attachment 18. The cap 62 is threaded onto the lowermost end of the nozzle 14 so that the boss 106 on the upper surface 102 of nozzle attachment 18 extends within a seat 126 formed in the base of nozzle 14 at the adhesive discharge opening 57 of adhesive passageway 56. With the nozzle attachment 18 in this position, the annular groove 112 communicates with the annular air chamber 95 formed in the base of the nozzle 14 at the end of the air delivery passageway 94. No O-rings or other seals are required between the upper surface 102 of the nozzle attachment 118 and the nozzle 14 in order to create a fluid-tight seal between the boss 106 and adhesive discharge opening 57 and a fluid-tight seal at the juncture of the annular groove 112 and air chamber 95. The nozzle attachment 18 is easily removed and replaced by another attachment of different size by rotating the cap 62 out of engagement with the nozzle 14.

Molten hot melt adhesive is transmitted through the gun body 12 of spray device 10 for discharge through the nozzle attachment 18 as follows. Molten hot melt adhesive is introduced into the adhesive cavity 46 of the gun body 12 through the adhesive inlet line 84. Adhesive flows from the adhesive cavity 46 into the nozzle 14 through the adhesive passageway 56. With the terminal end 59 of the plunger 22 in engagement with the seat 58 formed at the end of the adhesive passageway 56, as illustrated in FIG. 1, the adhesive is not permitted to flow through the adhesive discharge opening 57 of the adhesive passageway 56 to the throughbore 110.

In order to retract the plunger 22 and permit the flow of adhesive into the discharge opening 57, pilot air is first introduced through the operating air line 88, as described below, and then into the air cavity 20 in the gun body 12. This pilot air pressurizes the air cavity 20 and forces the plunger head plate 24 and plunger 22 upwardly so that its terminal end 59 disengages the seat 58 at the lower end of the adhesive passageway 56. The flow of hot melt adhesive through the adhesive discharge opening 57 of adhesive passageway 56 is transmitted into the throughbore 110 of nozzle attachment 18, and is discharged through the discharge outlet 111 to form the continuous adhesive stream 121. See FIG. 2. The plunger 22 is returned to its closed position to stop the flow of adhesive by discontinuing the flow of pilot air and depressurizing air cavity 20 allowing the return spring 34 to move the plunger 22 back into a seated position.

Referring again to FIG. 1, the system for supplying pilot air and atomizing air to the spray device 10 is schematically illustrated. Pressurized air from a source (not shown) is directed into a regulator 130 which is connected by line 132 to an air filter 134. The regulator 130 is effective to vary the air flow pressure from the source into line 132, and this pressure is monitored by an air gauge 136 connected to the line 132. A line 138 interconnects the filter 134 with a solenoid valve 140 having an exhaust 142, which, in the preferred embodiment, is closed by a plug 144 for purposes to become apparent below.

A line 146 exits the solenoid valve 140 and is divided into a branch line 148 and a second branch line 150. The branch line 148 is connected to the air line 88 formed in manifold 16 and supplies pilot air to the air cavity 20 to axially move the plunger 22 as described above. The branch line 150 is connected to a pneumatic stitcher device 152. In turn, the stitcher device 152 is connected by a line 154 having an air flow control valve 156 to the air inlet line 92 formed in air manifold 17. The air flow control valve 156 is effective to control the flow rate of the atomizing air which is ejected from the air jet bores 118 in the nozzle attachment 18 as discussed below.

The stitcher device 152 is a commercially available item such as that sold by Numatics, Inc. under Catalog No. TMO-2103. The stitcher device 152 is operative to receive pressurized air from the branch line 150 and discharge intermittent or pulsed bursts of air through the line 154 into the air inlet line 92 of air manifold 17. These pulsed or intermittent jets of air from stitcher device 152 pass through air inlet line 92, into the air delivery passageway 94 of gun body 12, through the air chamber 95 in nozzle 14, and then into the air jet bores 118 formed in the nozzle attachment 18 of nozzle 14. In the presently preferred embodiment, the stitcher device 152 is provided with a control knob 158 which permits adjustment of the frequency of the pulsed bursts or jets of air, i.e., the number of pulsed air jets per unit of time.

As shown in FIGS. 2 and 3, the air jet bores 118 are angled relative to the longitudinal axis of the throughbore 110 so that the pulsed air jets 160 are directed therethrough toward the center of the continuous adhesive stream 119 ejected from the discharge outlet 111 in the nozzle tip 108. These pulsed jets 160 of atomizing air are effective to cleanly shear discrete droplets 120 from the continuous adhesive stream 119, as discussed in more detail below, with minimal formation of angel hair, i.e., stringy or strand-like fibers of adhesive. The bell-shaped discharge outlet 111 of nozzle attachment 118 also aids in the formation of well defined droplets 120. These droplets 120 are deposited onto the substrate 121 in a partially spherical shape, and with sufficient mass, so that the open time of such droplets 120 is relatively long.

In the embodiment illustrated in FIG. 2, the substrate 121 is moving in the direction of the arrow relative to the fixed spray device 10. In order to effectively bond the substrate 121 to another substrate (not shown), a predetermined quantity of adhesive must be deposited per unit length of the substrate 121. Assuming the adhesive is supplied to the spray device 10 at constant pressure, the stitcher device 152 is adjusted to provide pulsed air jets 160 at a frequency such that the density of droplets 120 deposited onto the moving substrate 121 provides the desired quantity of adhesive thereon. As used herein, the term "density" refers to the number and spacing of individual globules or droplets 120 of adhesive per unit length of the substrate 121.

Depending upon the type of substrate to be bonded, the line speed or speed of the moving substrate 121 past the spray device 10 may widely vary. The stitcher device 152 employed herein permits adjustment of the frequency of the pulsed air jets 160 which impact the continuous adhesive stream 119 so that the desired density of droplets 120 is obtained per unit length of the substrate 121 regardless of the lineal speed of the substrate 121.

For example, if the speed of the moving substrate 121 is increased relative to spray device 10, the stitcher device 152 is adjustable by manipulating control knob 158 to increase the frequency of the pulsed air jets 160 discharged through the air jet bores 118 such that the same density of droplets 120 is deposited onto the substrate 121 per unit length as had been obtained at a slower speed. Conversely, if the speed of the moving substrate 121 is reduced, the stitcher device 152 is adjustable to reduce the frequency of the pulsed air jets 160 to obtain the same density of droplets 120 per unit length on the substrate 121 at such lower speed. In this manner, the desired density of adhesive per unit length of the substrate 121 can be obtained regardless of the speed thereof. Moreover, the frequency of the air jets 160 provided by stitcher device 152 can be adjusted to vary the density of adhesive, as desired, while the line speed of moving substrate 121 is maintained constant.

Upon completion of a spraying operation, it has been found that a residual quantity of adhesive might remain at the discharge outlet 111 of nozzle attachment 18. If not removed, such adhesive may drop from the nozzle attachment 18 on an undesired area of the substrate 121.

This problem is avoided in the instant invention by the provision of plug 144 in the solenoid valve 140. Normally, the air remaining in lines 146, 150 and in the stitcher device 152 would be bled off or exhausted through the exhaust 142 in solenoid 140. The insertion of plug 144 in exhaust 142, however, forces the residual air in lines 146, 150 and in the stitcher device 152 to flow forwardly through line 154, into air manifold 17 and then through the gun body 12 and nozzle 14 to the air jet bores 118 in nozzle attachment 18. This reverse flow of air through the air jet bores 118 dislodges any remaining adhesive on the discharge outlet 111 of nozzle tip 108 so that such residual adhesive is not deposited onto an unwanted area of substrate 121.

Figure 4:
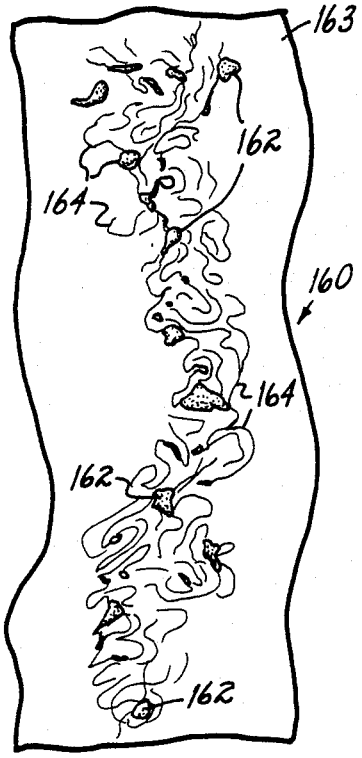
FIG. 4 is a schematic view of a stipple pattern of adhesive droplets produced by one mode of operation of the system herein.
Figure 5:
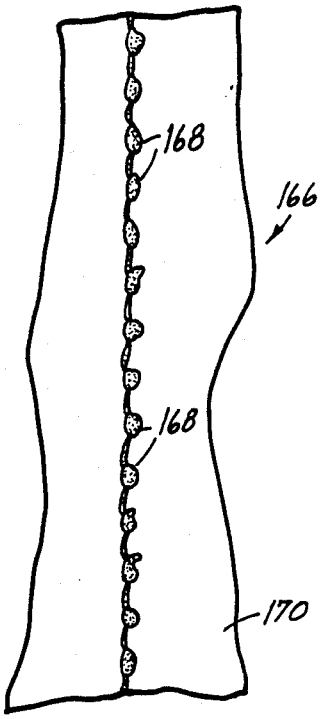
FIG. 5 is a schematic view of a straight-line pattern of adhesive droplets produced by an alternative mode of operation of the system.

Referring now to FIGS. 4 and 5, it has been found that different operating conditions of the system of this invention produce different adhesive patterns on a substrate. In the embodiment of FIG. 4, a stipple pattern 160 is illustrated in which adhesive droplets 162 are randomly dispersed onto a substrate 163, and are interconnected by at least some strand-like fibers 164 of adhesive. Alternatively, as shown in FIG. 5, the system of this invention can be operated to produce a pattern 166 in which adhesive droplets 168 of substantially uniform size are regularly spaced in a straight line along a substrate 170. Depending upon the requirements of a particular application, various parameters of the system are adjusted to obtain either the stipple pattern 160 of FIG. 4 or the straight-line pattern 166 of FIG. 5.

It is believed that the type of pattern obtained by the spraying system of this invention is dependent upon the energy with which the atomizing air discharged through the air jet bores 118 in nozzle attachment 18 impacts the exterior surface of the adhesive bead 119 ejected from the throughbore 110 in nozzle attachment 18. The term "energy" as used herein is meant to refer to the pressure, flow rate and the frequency of the intermittent, pulsed bursts of the atomizing air jets 160.

It has been found that a certain amount of energy is required for the atomizing air jets 160 to shear the continuous adhesive bead 119 into droplet form. Where the atomizing air jets 160 are provided with more energy than is required to shear the adhesive bead 119 into droplets, the atomizing air jets 160 project the adhesive droplets onto a substrate. Under these circumstances, the stipple pattern 160 shown in FIG. 4 is produced wherein the droplets 162 are randomly deposited onto the substrate by the atomizing air jets 160 and at least some strand-like fibers 164 are formed in between the droplets 162. In the embodiment of FIG. 5, the energy of the atomizing air jets 160 is set at a level which is only sufficient to shear the adhesive bead 119 to form droplets 168. As a result, the droplets 168 are permitted to fall to the substrate 170 under the influence of gravity and also due to the momentum of the adhesive stream passing through the throughbore 118 of nozzle attachment 18. Because the droplets 168 are not projected onto the substrate by the atomizing air jets 160, a relatively straight-line, longitudinally extending pattern 166 is formed on substrate 170 in which the adhesive droplets 168 are of substantially uniform size and are regularly spaced from one another.

It has been observed that three parameters effect the "energy" of the atomizing air jets 160 which form the droplets 162 or 168. These parameters include the pressure, flow rate and the frequency of the intermittent or pulsed bursts of the atomizing air jets 160. As illustrated in FIG. 1, the pressure of the atomizing air is controlled by the regulator 130 which is interconnected between the source (not shown) of pressurized air and the main delivery line 132 to the system. The flow rate of atomizing air to the nozzle attachment 18 is controlled by the air flow control valve 156 mounted in line 154 leading to the air inlet line 92 of air manifold 17. The frequency of the intermittent or pulsed bursts of atomizing air is controlled by operation of the stitcher device 152 as discussed above.

Depending upon the type of hot melt thermoplastic adhesive employed and the hydraulic pressure under which the adhesive is maintained within the spray device 10, the regulator 130, stitcher 152 and flow control valve 156 are all adjusted to produce either a stipple pattern 160 or a straight-line pattern 166 illustrated in FIGS. 4 and 5, respectively. Because of the wide variety of thermoplastic adhesives and varying operating conditions of commercially available dispensing devices, it is not feasible to quantify various settings of regulator 130, stitcher 152 and/or air flow control valve 156 which would produce a stipple pattern 160 or straight-line pattern 166 for every conceivable application. It is contemplated, however, that a minimal amount of experimentation by the operator would successfully produce the type of pattern desired. As discussed above, lower "energy" atomizing air jets 160 tend to produce a straight-line pattern 166 because the atomizing air jets 160 merely shear the adhesive into droplets and do not project such droplets onto the substrate. Therefore, in order to obtain a straightline pattern 166, the regulator 130, stitcher 152 and/or air flow control valve 156 are adjusted to decrease the pressure, frequency of the pulses and/or flow rate of the atomizing air to decrease its energy. On the other hand, the stipple pattern 160 is produced by higher energy atomizing air jets 160, and this is obtained by increasing the pressure, frequency of the pulses of air jets 160 and/or flow rate of the atomizing air by appropriate adjustment of the regulator 130, stitcher 152 and air flow control valve 156. It is contemplated that such adjustments would be made by an operator by initially dispensing a bead 119 of adhesive from the nozzle attachment 118, impacting the bead with atomizing air, and then adjusting the settings of regulator 130, stitcher 152 and/or air flow control valve 156 to obtain the desired bead pattern.

The following examples are provided as illustrative of different combinations of operating parameters of the system of this invention which produce either a stipple pattern 160 or a straight-line pattern 166.

| Example I | |
|---|---|
| Thermoplastic Adhesive: | CF204 |
| Adhesive Temperature: | 325° F. |
| Hydraulic Pressure: | 80 psig |

-continued

| Example I | |
|---|---|
| Atomizing Air Pressure: | 48 psig |
| Atomizing Air Flow Rate: | .6489 SCFM |
| Atomizing Air Pulse Frequency: | 1350 CPM |
| Example II | |
| Thermoplastic Adhesive: | CF204 |
| Adhesive Temperature: | 325° F. |
| Hydraulic Pressure: | 80 psig |
| Atomizing Air Pressure: | 48 psig |
| Atomizing Air Flow Rate: | .6489 SCFM |
| Atomizing Air Pulse Frequency: | 2500 CPM |

Under the operating conditions given above in Examples I and II, a stipple pattern 160 of the type shown in FIG. 4 was obtained.

| Example III | |
|---|---|
| Thermoplastic Adhesive: | National Starch 34-2850 |
| Adhesive Temperature: | 350° F. |
| Hydraulic Pressure: | 87 psig |
| Atomizing Air Pressure: | 55 psig |
| Atomizing Air Flow Rate: | 2.00 SCFM |
| Atomizing Air Pulse Frequency: | 1935 CPM |
| Example IV | |
| Thermoplastic Adhesive: | National Starch 34-2850 |
| Adhesive Temperature: | 321° F. |
| Hydraulic Pressure: | 200 psig |
| Atomizing Air Pressure: | 35 psig |
| Atomizing Air Flow Rate: | 1.27 SCFM |
| Atomizing Air Pulse Frequency: | 1739 CPM |
| Example V | |
| Thermoplastic Adhesive: | National Starch 34-2850 |
| Adhesive Temperature: | 320° F. |
| Hydraulic Pressure: | 140 psig |
| Atomizing Air Pressure: | 67 psig |
| Atomizing Air Flow Rate: | 1.63 SCFM |
| Atomizing Air Pulse Frequency: | 1411 CPM |

Under the operating conditions given above in Examples III–V, a straight-line pattern 166 of the type shown in FIG. 5 was obtained.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. The method of depositing molten thermoplastic material onto a substrate, comprising:

ejecting a continuous stream of molten thermoplastic material from a discharge outlet, said stream having momentum in a direction toward the substrate and having an exterior surface;

intermittently impacting said stream of molten thermoplastic material with a jet of atomizing air which initially contacts said exterior surface of said stream to shear said stream of molten thermoplastic material into droplets;

controlling the energy with which said jet of atomizing air impacts said stream so that said droplets are allowed to fall onto the substrate under the influence of gravity and due to the momentum of said stream, said droplets being deposited onto the substrate in a pattern wherein said droplets are substantially uniformly spaced from one another and are of substantially uniform size.

2. The method of claim 1 in which said step of controlling the energy with which said jet of atomizing air impacts the stream comprises controlling the pressure of said jet of atomizing air.

3. The method of claim 1 in which said step of controlling the energy with which said jet of atomizing air impacts the stream comprises controlling the flow rate of said jet of atomizing air.

4. The method of claim 1 in which said step of controlling the energy with which said jet of atomizing air impacts the stream comprises controlling the frequency with which the jet of atomizing air intermittently impacts the stream.

5. The method of depositing molten thermoplastic material onto a substrate, comprising:

ejecting a continuous stream of molten thermoplastic material from a discharge outlet;

intermittently impacting said stream of molten thermoplastic material with a jet of atomizing air which initially contacts the exterior of said stream to shear said stream into droplets;

controlling the energy with which said jet of atomizing air impacts said stream so that said droplets are projected by said jet of atomizing air onto the substrate in a stipple pattern wherein said droplets are essentially randomly spaced from one another.

6. The method of claim 5 in which said step of controlling the energy with which said jet of atomizing air impacts the stream comprises controlling the pressure of said jet of atomizing air.

7. The method of claim 5 in which said step of controlling the energy with which said jet of atomizing air impacts the stream comprises controlling the flow rate of said jet of atomizing air.

8. The method of claim 5 in which said step of controlling the energy with which said jet of atomizing air impacts the stream comprises controlling the frequency with which the jet of atomizing air intermittently impacts the stream.

9. The method of depositing molten thermoplastic material onto a substrate, comprising:

ejecting a continuous stream of molten thermoplastic material from a discharge outlet, said stream having momentum in a direction toward the substrate and having an exterior surface;

intermittently impacting said stream of molten thermoplastic material with a jet of atomizing air having a pressure and flow rate which initially contacts said exterior surface of said stream to shear said stream of molten thermoplastic material into droplets;

adjusting at least one of the pressure, flow rate and frequency with which said jet of atomizing air impacts said stream so that said droplets are allowed to fall onto the substrate under the influence of gravity and due to the momentum of said stream, said droplets being deposited onto the substrate in a pattern wherein said droplets are substantially uniformly spaced from one another and are of substantially uniform size.

10. The method of depositing molten thermoplastic material onto a substrate, comprising:

ejecting a continuous stream of molten thermoplastic material from a discharge outlet;

intermittently impacting said stream of molten thermoplastic material with a jet of atomizing air having a pressure and flow rate which initially contacts the exterior of said stream to shear said stream into droplets;

adjusting at least one of the pressure, flow rate and frequency with which said jet of atomizing air impacts said stream so that said droplets are projected by said jet of atomizing air onto the substrate in a stipple pattern wherein said droplets are essentially randomly spaced from one another.

11. The method of depositing molten thermoplastic material onto a substrate, comprising:

ejecting a continuous stream of molten thermoplastic material from a discharge outlet, said stream having momentum in a direction toward the substrate and having an exterior surface;

intermittently impacting said stream of molten thermoplastic material with a jet of atomizing air which initially contacts said exterior surface of said stream to shear said stream of material into a predetermined number of droplets per unit of time;

controlling the energy with which said jet of atomizing air impacts said stream so that said droplets are allowed to fall onto the substrate under the influence of gravity and due to the momentum of said stream, said droplets being deposited onto the substrate in a pattern wherein said droplets are substantially uniformly spaced from one another and are of substantially uniform size;

adjusting the frequency of said intermittent jets of atomizing air according to the lineal speed of the moving substrate to deposit a predetermined number of droplets upon a unit length of the moving substrate.

12. The method of depositing molten thermoplastic material onto a substrate, comprising:

ejecting a continuous stream of molten thermoplastic material from a discharge outlet;

intermittently impacting said continuous stream of molten thermoplastic material with a jet of atomizing air which initially contacts the exterior of said stream to shear said stream into a predetermined number of droplets of thermoplastic material per unit of time;

controlling the energy with which said jet of atomizing air impacts said stream so that said droplets are projected by said jet of atomizing air onto the substrate in a stipple pattern wherein said droplets are essentially randomly spaced from one another;

adjusting the frequency of said intermittent jets of atomizing air according to the lineal speed of the moving substrate to deposit a predetermined number of droplets upon a unit length of the moving substrate.

13. Apparatus for depositing molten thermoplastic material onto a substrate, comprising:

means for ejecting a continuous stream of molten thermoplastic material from a discharge outlet, said stream having momentum in a direction toward the substrate and having an exterior surface;

means for intermittently impacting said stream of molten thermoplastic material with a jet of atomizing air which initially contacts said exterior surface of said stream to shear said stream of molten thermoplastic material and form droplets;

means for controlling the energy with which said jet of atomizing air impacts said stream so that said droplets are allowed to fall onto the substrate under the influence of gravity and due to the momentum of said stream, said droplets being deposited onto the substrate in a pattern wherein said droplets are substantially uniformly spaced from one another and are of substantially uniform size.

14. Apparatus for depositing molten thermoplastic material onto a substrate, comprising:

a spray device having a nozzle formed with a discharge outlet for ejecting a continuous stream of molten thermoplastic material, said stream having momentum in a direction toward the substrate;

means for discharging atomizing air which initially impacts the exterior of said continuous stream of molten thermoplastic material;

means for intermittently interrupting the flow of said atomizing air to form intermittent jets of atomizing air which impact said continuous stream of molten thermoplastic material to shear said continuous stream and form droplets;

means for controlling the energy with which said jet of atomizing air impacts said stream so that said droplets are projected by said jet of atomizing air onto the substrate in a stipple pattern wherein said droplets are essentially randomly spaced from one another.

* * * * *